US005544435A

United States Patent [19]

Somero

[11] Patent Number: 5,544,435

[45] Date of Patent: Aug. 13, 1996

[54] BRUSH RAKE

[76] Inventor: Nick Somero, Rte. 1, Box 133, Raymond, Wash. 98577

[21] Appl. No.: 312,693

[22] Filed: Sep. 27, 1994

[51] Int. Cl.[6] ..... E02F 3/96; E02F 3/00

[52] U.S. Cl. ..... 37/405; 37/406; 37/301; 37/403; 414/722; 414/724; 294/104

[58] Field of Search ..... 37/403, 405, 406, 37/407, 301, 443; 294/104, 67.22; 414/722, 724, 912; 56/DIG. 12

[56] References Cited

U.S. PATENT DOCUMENTS

| | | | |
|---|---|---|---|
| 2,950,551 | 8/1960 | Pesce | 172/766 |
| 3,274,710 | 9/1966 | Wright | 37/301 |
| 3,595,416 | 7/1971 | Perrotti . | |
| 3,778,111 | 12/1973 | Ciofani . | |
| 4,041,624 | 8/1977 | Fryrear . | |
| 4,077,529 | 3/1978 | Leyrat et al. . | |
| 4,125,952 | 11/1978 | Jennings | 414/724 X |
| 4,140,348 | 2/1979 | Strada | 37/301 X |
| 4,285,628 | 8/1981 | Jankowski | 414/912 X |
| 4,372,063 | 2/1983 | Work | 414/912 X |
| 4,375,345 | 3/1983 | Hanson | 414/722 |
| 4,407,080 | 10/1983 | Mann . | |
| 4,407,626 | 10/1983 | Bruckner | 294/104 X |
| 4,519,739 | 5/1985 | Risch | 414/724 |
| 4,799,852 | 1/1989 | Ramun | 414/724 |
| 5,094,581 | 3/1992 | Lamb | 414/724 X |
| 5,150,936 | 9/1992 | Avery | 294/104 |

*Primary Examiner*—Terry Lee Melius
*Assistant Examiner*—Thomas A. Beach
*Attorney, Agent, or Firm*—Brian J. Coyne

[57] ABSTRACT

A brush rake for attachment to an excavator arm equipped with a bucket and a thumb having inner and outer pairs of teeth. The brush rake has a parallel array of rake teeth attached to a rake bar, and a mounting plate having one end thereof attached to the rake bar. An opposite end of the mounting plate is adapted to overlie the body of the thumb and to be received between the outer pair of teeth of the thumb. A parallel pair of apertured ears attached to the rake bar is so disposed thereon that when the rake bar is placed adjacent and transversely with respect to the teeth of the thumb, the ears lie adjacent and on opposite sides of the inner teeth of the thumb. Mounting holes are provided in the mounting plate and matching holes are bored through the body of the thumb. The brush rake is attached to the thumb by inserting pins through the ears and through holes bored through the inner teeth of the thumb, and by inserting mounting bolts through the mounting holes and matching holes in the thumb.

5 Claims, 5 Drawing Sheets

BRUSH RAKE

BACKGROUND OF THE INVENTION

1. Field of the Invention

This invention relates to brush rakes, and more specifically to a brush rake for mounting on the articulated boom of an excavator.

2. Description of the Prior Art

Land clearing operations, such as cutting a roadway through a forest, include felling of trees followed by removal of logs, stumps, plant roots and brush. An excavator equipped with a boom, an arm attached to the boom, and a thumb and bucket attached to a free end of the arm, can grasp and remove stumps. Neither a thumb nor a bucket are suitable for removal of plants roots and brush, however, because their teeth are too short and both lack sufficient breadth to cut a wide swath through roots and brush in a single pass. Therefore, prior to my invention, the conventional method for removing plant roots and brush has been to disattach the bucket and mount a brush grapple to the free end of the arm; then, once the plant roots and brush were torn out of the ground in the vicinity of the excavator with the brush grapple, the brush grapple was disattached and the bucket was reattached to the arm preparatory to removal of additional stumps. The necessity for repeated and alternating attachment and disattachment of the bucket and brush grapple significantly slowed land clearing operations.

SUMMARY OF THE INVENTION

The present invention significantly improves the efficiency of land clearing operations with an excavator by eliminating the necessity for repeated and alternating attachment and disattachment of a bucket and a brush grapple. The invention provides a brush rake for mounting on an excavator equipped with a boom, an arm, a bucket and a thumb having inner and outer pairs of teeth reinforced by gussets, and a hydraulic system for controlling movements of the boom and the thumb. In a preferred embodiment, the brush rake comprises a rake bar to which are attached a plurality of rake teeth that extend away from the rake bar in a longitudinal direction, and a mounting plate having a first end portion attached to the rake bar, a second opposite end portion that extends away from the rake bar in a reverse longitudinal direction, and an intermediate portion integral with the first and second end portions. The second end portion of the mounting plate is adapted to closely overlie the thumb and be received between the outer pair of teeth of the thumb. Mounting the brush rake to the excavator arm only requires insertion of bolts through holes in the second end portion of the mounting plate into the thumb, and insertion of pins through transverse holes bored in the inner teeth and through apertured ears attached to the rake bar.

Figure 1:
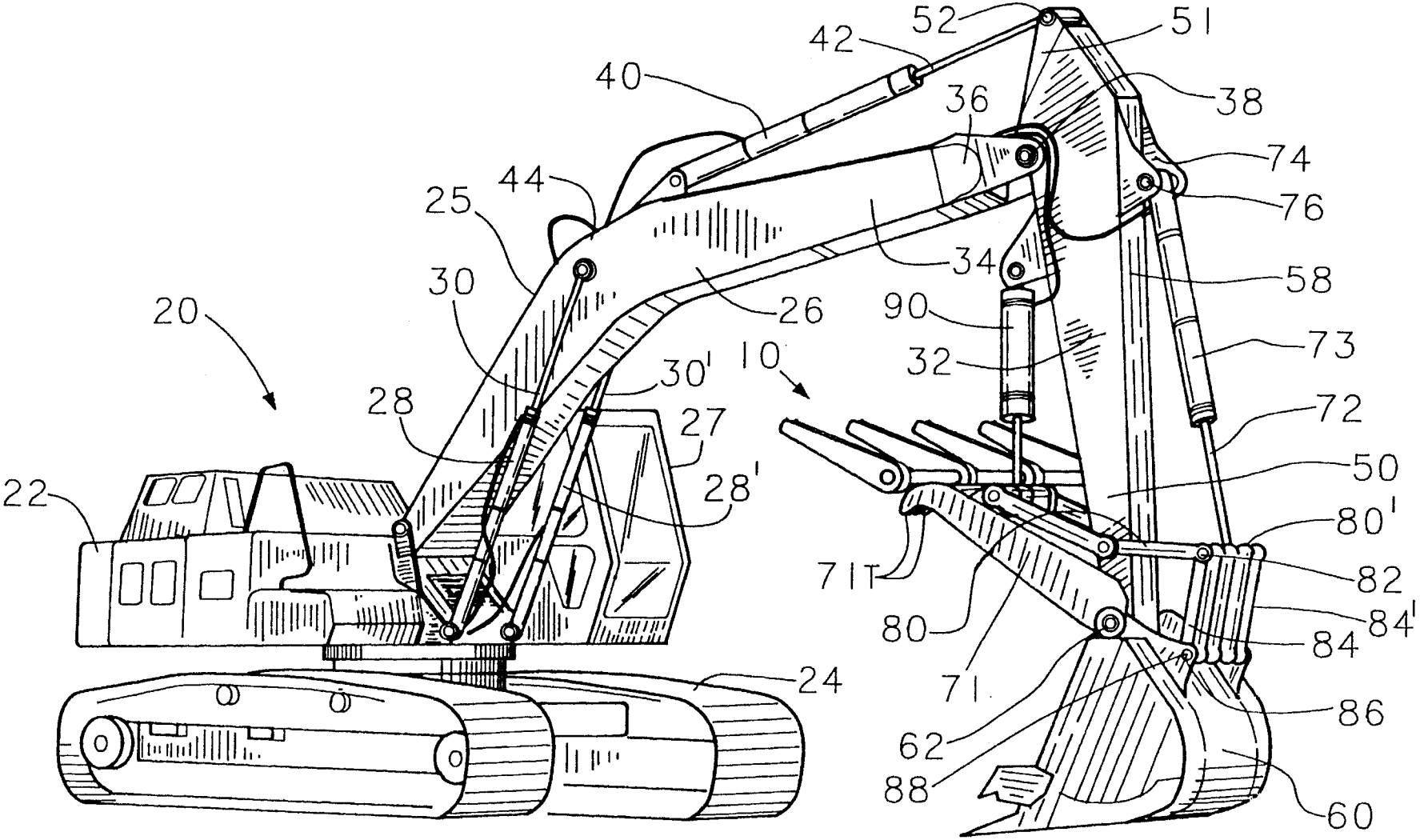
FIG. 1 is a frontal perspective view of an excavator equipped with a bucket, shown in lowered position, a thumb, shown in raised position, and with a brush rake according to the present invention attached to the thumb.

The terms "front" and "forward" as used herein generally refer to the right portions of the excavator as illustrated in FIG. 1; similarly the terms "rear" and "rearward" refer to the left portions of the excavator so illustrated. The term "longitudinal direction" as used herein is defined by the sequence progressing from the excavator body through the boom, arm, thumb and brush rake, and the term "reverse longitudinal direction" is the reverse thereof.

DESCRIPTION OF THE PREFERRED EMBODIMENT

Referring now to the drawings, a brush rake according to the present invention is illustrated in FIG. 1 and shown generally by reference numeral 10. The brush rake 10 is shown mounted on an excavator 20, e.g., a model 790D-LC manufactured by John Deere Company of Moline, Ill., which includes a body 22 mounted on treads 24. A cab 27 is mounted on a front portion of the body 22. A boom 25 is carried by the body 22, from which it extends forwardly and with which it swings about a vertical axis with respect to the treads 24 in response to activation of control levers by an operator in the cab 27. A parallel pair of hydraulic boom cylinders 28, 28', which include pistons (not shown) and piston rods 30, 30', are each connected at one end to a front portion of the body 22 and at an opposite end to a central portion of the boom 26. A forward portion of the boom 34 is fitted with a clevis 36 to which an arm 32 is pivotally mounted by an arm pin 38 for rotation about a horizontal axis. An arm cylinder 40 is attached to an upper surface 44 of a central portion of 26 of the boom 22 with the piston rod 42 thereof pivotally connected by drive pin 52 to a rear clevis 51 of the arm 32 that extends rearward from pin 38. A forward portion 50 of the arm 32 is fitted with a transverse pin boss (not shown) for pivotally mounting by bucket pin 62 both a bucket 60 and a thumb 71 for rotation about a common horizontal axis. That is, by removing bucket pin 62 either the bucket 60 or the thumb 71, or both, may be removed from the arm 32.

A bucket cylinder 73 comprising a piston (not shown) and a bucket cylinder rod 72 is pivotally attached by bucket drive pin 76 to a bucket drive clevis 74 mounted on an upper surface 58 of the arm 32. A parallel pair of arm linkage bars 80, 80' each have one end pivotally connected to a front portion 50 of arm 32 and an opposite end connected to the bucket cylinder rod 72 by linkage pin 82. A parallel pair of bucket linkage bars 84, 84' each have one end pivotally attached to a bucket control clevis 86 by bucket control clevis pin 88 and an opposite end attached to linkage pin 82. A thumb cylinder 90 attached to the arm 32 actuates movements of the thumb 71.

Figure 2:
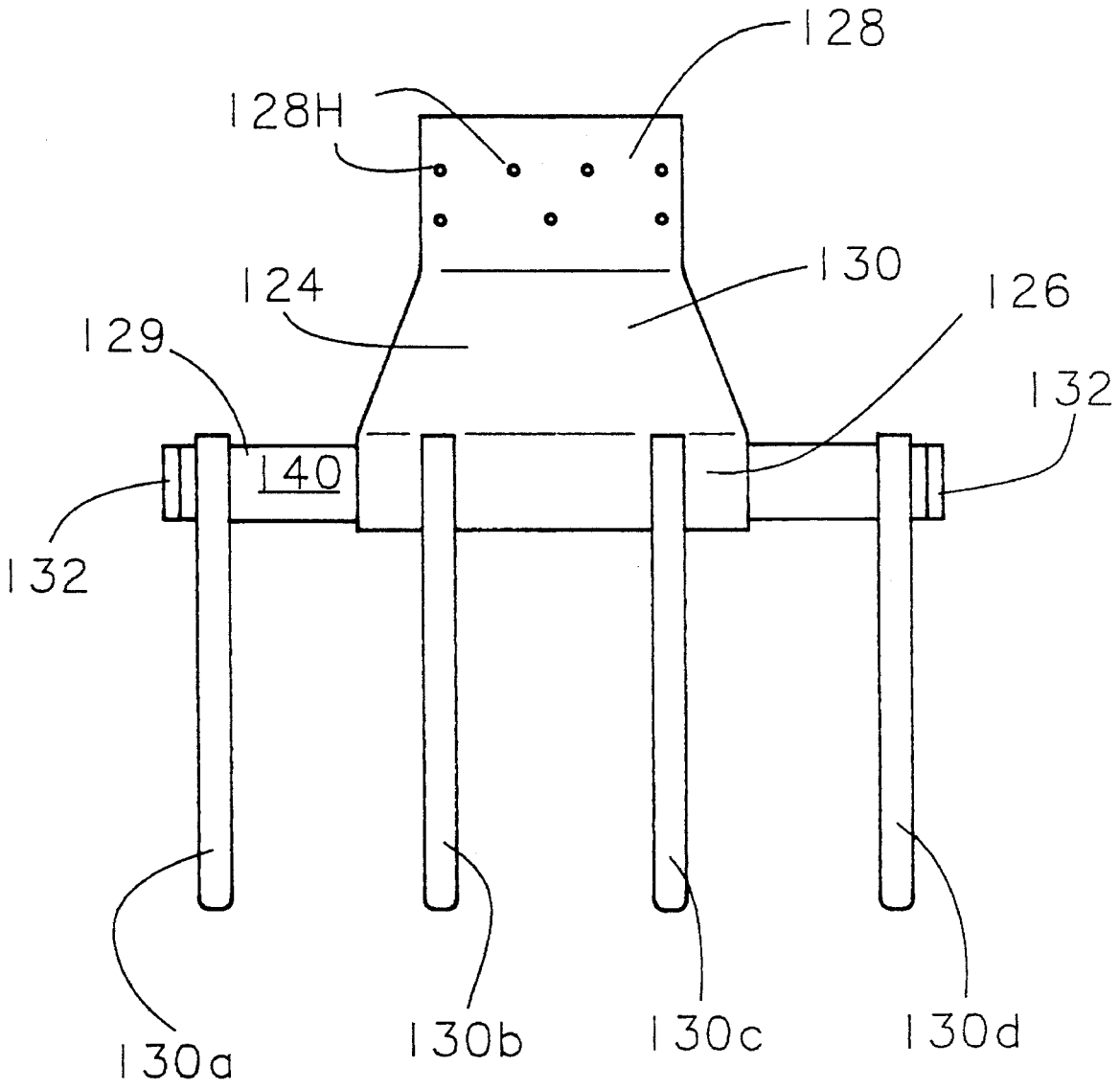
FIG. 2 is an enlarged plan view of the brush rake disattached from the thumb.

Referring now to FIG. 2, in the preferred embodiment, the brush rake 10 comprises a rake bar, such as tube 129, having sufficient length that a plurality of rake tines or teeth 130*a*, 130*b*, 130*c*, 130*d*, mounted thereon can cut an adequately wide swath through soil, plant roots and brush. In the preferred embodiment, four rake teeth 130*a–d* are shown mounted on the rake bar 129, but the number of rake teeth might be as few as two or as many as eight. Each end of the tube 129 is sealed by a circular cap 132 inserted therein. The brush rake 10 further comprises a mounting plate 124 having a first end portion 126 attached to the rake bar 129 and a second, opposite end portion,128 which is preferably rectangular in plan form, having a plurality of mounting holes 128H. Intermediate the first and second end portions 126, 128, of the mounting plate 124 is a third, intermediate portion 130, which is integral with the first and second end portions 126, 128 and preferably trapezoidal in plan form—that is, the third portion 130 progressively tapers from the relatively wide width W of the first end portion 126 to the relatively narrow width W' of the second end portion 128. The first end portion 126 is preferably contoured to partially envelop part of the exterior surface 140 of the tube 129, to which it is rigidly connected.

Figure 3:
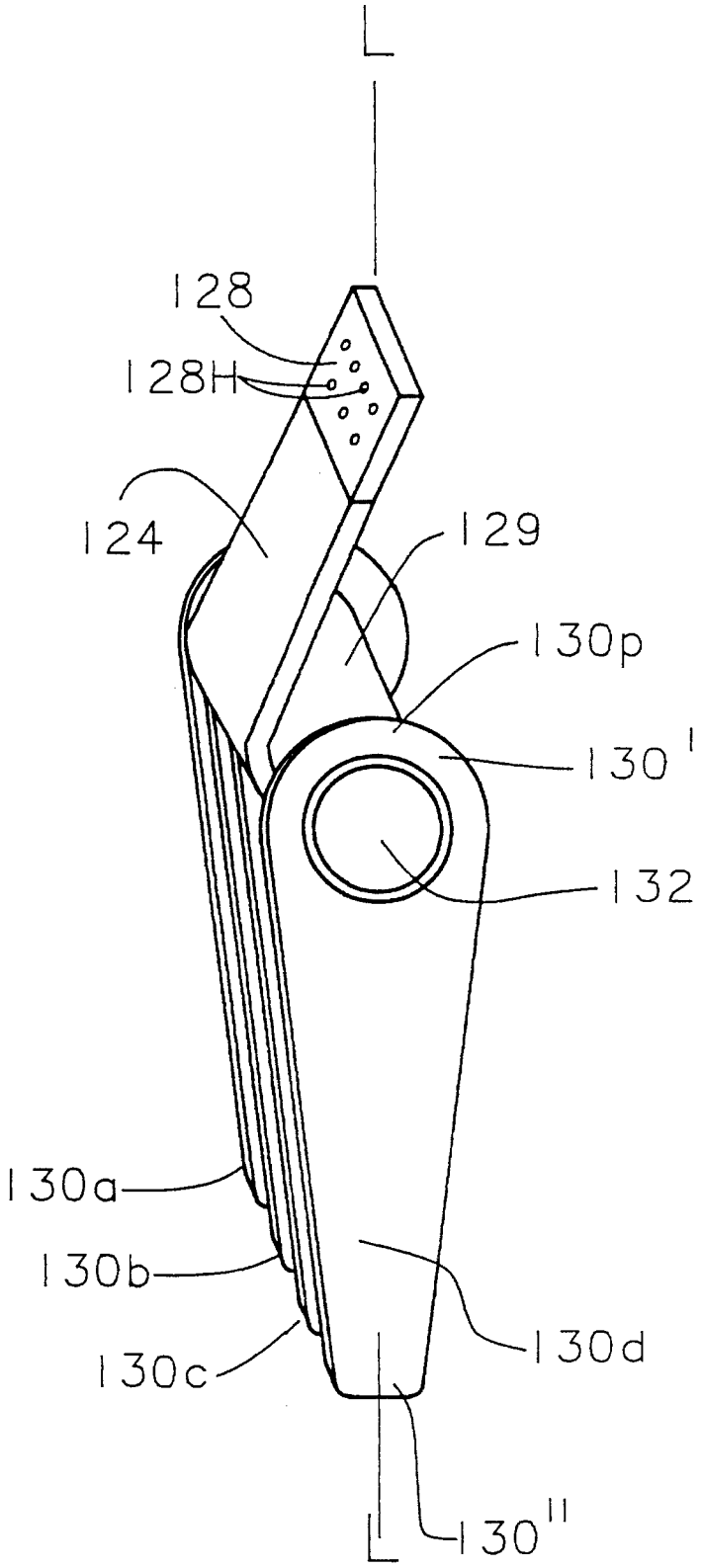
FIG. 3 is a side elevational perspective view of the brush rake.

As may best be seen in FIG. 3, each of the rake teeth 130*a–d*, has a first end 130' with a semicircular periphery 130P and an opposite end, pointed free end 130". The first end 130' of each rake tooth 130*a–d* has a circular bore with a diameter slightly larger than the exterior diameter of the tube 129, whereby the teeth 130*a–d* are rigidly mounted on the tube 129 in parallel, spaced relation.

Figure 4:
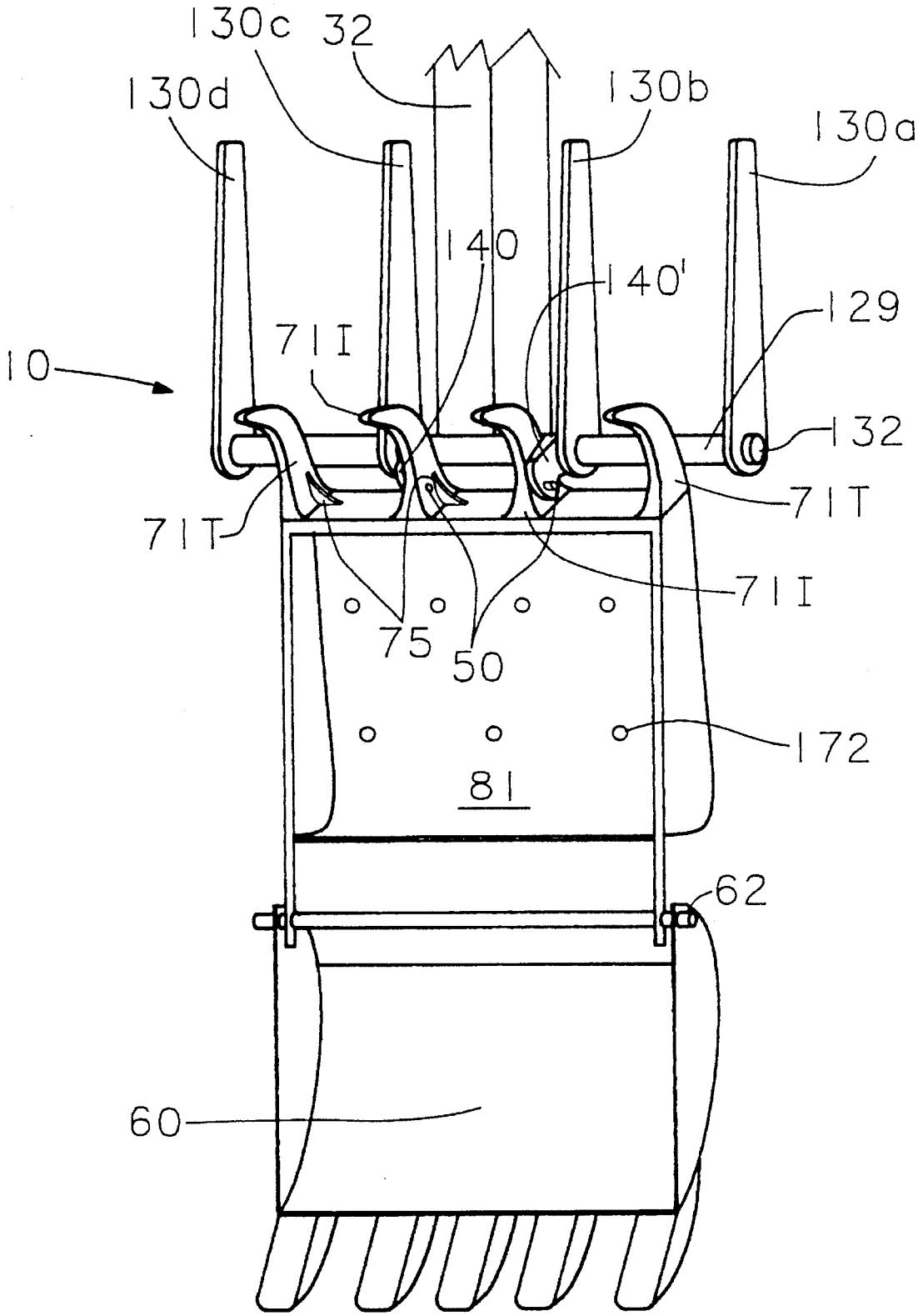
FIG. 4 is a an underside perspective plan view of the thumb and bucket with the brush rake attached to the thumb, as viewed in a direction normal to the longitudinal axis L of the thumb.
Figure 5:
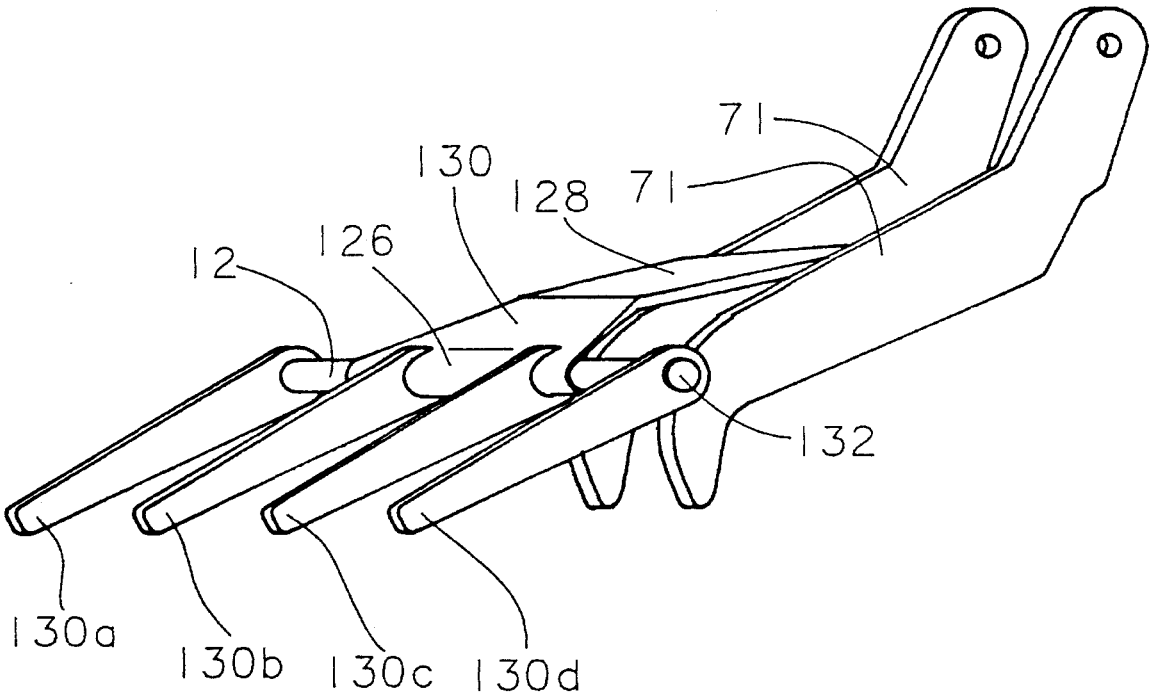
FIG. 5 is a right frontal perspective view of the thumb, removed from the excavator arm, with the brush rake attached.

Referring now to FIG. 4, the thumb 71 is shown in raised position, and the bucket 60 in lowered position, attached to the arm 32. It may be seen that the brush rake further comprises a parallel pair of apertured ears 140, 140' attached to the rake bar 129 and so located thereon that when the rake bar 129 is positioned adjacent and transversely with respect to the pairs of outer teeth 71T and inner teeth 71I of the thumb 71, the ears 140, 140' lie adjacent and on opposite sides of the inner teeth 71I. The inner teeth 71I and outer teeth 71T are reinforced by gussets 75. The inner teeth 71I are also apertured transversely and a plurality of holes are bored in the central body surface 81 of the thumb 71 to mate with the mounting holes 128H of the brush rake when the second end portion 128 of the mounting body 124 is made to closely overlie the central body surface 81 of the thumb 71; see, e.g., FIG. 5. Thus, attachment of the brush rake 10 to the thumb 71 only requires insertion of a pair of ear mounting pins 50 through the apertured ears 140, 140' and the inner teeth 71I of the thumb 71, and insertion of a plurality of mounting bolts through mounting holes 128H and 172. The reverse procedure quickly and easily detaches the brush rake 10 from the thumb 71. Proceeding in this manner, an excavator operator can quickly convert from using the thumb-and-bucket combination 60, 71, for digging and lifting away large objects, such as stumps, to removal of plant roots and brush using the brush rake 10—all without ever removing the bucket 60, the thumb 71, or the brush rake 10 from the arm 32. The thumb 71 serves to maintain the brush rake away from the bucket so that the bucket does not interfere with brush raking operations.

Various details of the invention may be changed without departing from its scope. For example, the rake bar 129 could be rectangular in cross-section instead of circular. A second pair of ears could be added to the rake bar 129 for attachment by an additional pair of pins to the outer teeth 71T of the thumb 71 in order to increase the strength and stability of attachment of the rake brush 10 to the arm 32. Furthermore, the description of the preferred embodiment according to the present invention is provided for the purpose of illustration only and not for the purpose of limitation—the invention being defined by the claims.

I claim:

1. A brush rake for mounting on an excavator equipped with a boom, an arm, a bucket, and a thumb operably connected to said arm having inner and outer teeth reinforced by gussets, and a hydraulic system for controlling movements of the boom and the thumb, comprising:

(a) a rake bar;

(b) a plurality of spaced-apart, parallel, rake teeth each having a first end attached to the rake bar and a second, opposite, pointed free end extending away from the rake bar in a longitudinal direction;

(c) a mounting plate having a first portion attached to the rake bar, a second, opposite portion that extends away from the rake bar in a reverse longitudinal direction, and a third portion intermediate the first and second portions and integral therewith; and (d) means for attaching the brush rake to the thumb without requiring removal of the bucket from the arm;

wherein the rake bar is a tube sealed by caps inserted into the opposite ends thereof, and the first end of each rake tooth has a bore through which is inserted the rake bar, whereby each rake tooth is rigidly attached to the rake bar.

2. The brush rake of claim 1 wherein the rake bar is a cylindrical tube sealed by circular caps and the bore in the first end of each rake tooth is circular.

3. The brush rake of claim 1, wherein the periphery of the first end of each rake tooth is semicircular and each tooth is tapered in the longitudinal direction from a relatively wide first end to a second, relatively narrow, pointed end.

4. The rake of claim 1 wherein the second portion has a plurality of mounting holes and is adapted to closely overlie the thumb and be received between the outer teeth of the thumb.

5. The rake of claim 4, wherein the means for attaching the brush rake to the thumb without requiring removal of the bucket comprises:

(a) a parallel pair of apertured ears attached to the rake bar and so located thereon that when the rake bar is positioned adjacent and transversely with respect to the teeth of the thumb, the ears lie adjacent and on opposite sides of the inner teeth of the thumb;

(b) a pair of pins for insertion through the apertures of the ears and through holes bored transversely through the inner teeth; and (c) a plurality of mounting bolts for insertion through mounting holes in the mounting plate and through a matching plurality of holes bored through the thumb.

* * * * *